US009480291B2

(12) United States Patent
Joffe et al.

(10) Patent No.: US 9,480,291 B2
(45) Date of Patent: Nov. 1, 2016

(54) GLOVE ACCESSORY

(71) Applicants: Diane Joffe, New York, NY (US); Stacey Abrahams, New York, NY (US)

(72) Inventors: Diane Joffe, New York, NY (US); Stacey Abrahams, New York, NY (US)

( * ) Notice: Subject to any disclaimer, the term of this patent is extended or adjusted under 35 U.S.C. 154(b) by 0 days.

(21) Appl. No.: 14/150,243

(22) Filed: Jan. 8, 2014

(65) Prior Publication Data

US 2014/0189932 A1 Jul. 10, 2014

Related U.S. Application Data

(60) Provisional application No. 61/749,971, filed on Jan. 8, 2013, provisional application No. 61/893,565, filed on Oct. 21, 2013.

(51) Int. Cl.
*A41D 19/00* (2006.01)

(52) U.S. Cl.
CPC ..... *A41D 19/0024* (2013.01); *A41D 19/0044* (2013.01)

(58) Field of Classification Search
CPC ..... A41D 19/002; A41D 19/00; A41D 19/0037; A41D 19/01594; A41D 19/0024; A41D 19/0044; A41D 3/00
USPC ..... 2/160, 159; 345/179
See application file for complete search history.

(56) References Cited

U.S. PATENT DOCUMENTS

| | | | | |
|---|---|---|---|---|
| 2,227,781 | A * | 1/1941 | Joy et al. | 219/211 |
| 3,632,966 | A * | 1/1972 | Arron | 219/211 |
| 6,009,557 | A * | 1/2000 | Witta | 2/159 |
| 6,904,614 | B2 * | 6/2005 | Yamazaki et al. | 2/159 |
| 7,874,021 | B2 * | 1/2011 | Sunder et al. | 2/163 |
| 2001/0006173 | A1 * | 7/2001 | Rock et al. | 219/545 |
| 2010/0090966 | A1 * | 4/2010 | Gregorio | 345/173 |
| 2011/0016609 | A1 * | 1/2011 | Phelps et al. | 2/162 |
| 2011/0047672 | A1 * | 3/2011 | Hatfield | 2/163 |
| 2011/0265245 | A1 * | 11/2011 | Asiaghi | 2/167 |
| 2011/0277215 | A1 * | 11/2011 | Lee et al. | 2/163 |
| 2011/0278061 | A1 * | 11/2011 | Farnan | 174/70 R |
| 2011/0289654 | A1 * | 12/2011 | Williams et al. | 2/167 |
| 2012/0167272 | A1 * | 7/2012 | Scaff | 2/160 |
| 2013/0086730 | A1 * | 4/2013 | Wilkening et al. | 2/161.1 |

FOREIGN PATENT DOCUMENTS

CN 202211192 U * 5/2012

* cited by examiner

*Primary Examiner* — Shaun R Hurley
*Assistant Examiner* — Bao-Thieu Nguyen
(74) *Attorney, Agent, or Firm* — Sofer & Haroun, LLP

(57) ABSTRACT

A glove accessory includes a hand portion, a thumb portion and an index finger portion. The accessory is configured to be applied over a gloved hand of a user. At least one of the thumb portion or the index finger portion or both maintain a touch screen active tip that is in electrical communication with the hand portion of the glove accessory, sufficient to allow electrical contact with the skin of the wearer below a wrist of the gloved hand.

7 Claims, 10 Drawing Sheets

GLOVE ACCESSORY

RELATED APPLICATION

This application claims the benefit of priority from U.S. Provisional Application No. 61/749,971 filed on Jan. 8, 2013, and U.S. Provisional Application No. 61/893,565, filed on Oct. 21, 2013, the entirety of which are incorporated by reference.

BACKGROUND

1. Field of the Invention

This application relates to a glove accessory. More particularly, the present arrangement relates to a glove accessory for use in connection with electronic touch screen devices.

2. Description of Related Art

With the proliferation of touch screen enabled electronic devices, such as touch screen mobile phones, pad computers etc. . . . , gloves have been made that include a touch screen interface area, typically on the end of the forefinger, allowing the wearer to interact with the device.

One form of touch screen includes a conductive layer coated on one surface of the screen, with a small voltage applied thereto, creating a uniform electrostatic field. When the user's finger, a conductor, touches the other uncoated surface, a capacitor is formed. The screen can determine the location of the touch indirectly from the change in the capacitance as measured from the four corners of the panel. Several other forms of touch screens are also available, but in each case, some form of conductor or human touch is needed to operate the screen.

In order to operate, the touch screen gloves include a conductive material in the touch screen interface area to allow the conductive properties of the finger to pass through the gloves' primary insulating (non-conductive) material.

However, such gloves do not allow for a wide latitude of styles and thicknesses/materials. If a user wants to employ such gloves so they can continue to use their device, they are limited to the particular gloves which have the touch screen interface area, which may not be of the desired thickness or of the desired style, nor allow for the ease of use.

OBJECTS AND SUMMARY OF THE INVENTION

The present invention overcomes the drawbacks associated with the prior art and provides a glove accessory that can be fitted over an ordinary glove (that does not have a touch screen interface area) so that a user may continue to use their ordinary stock of gloves in different styles. The glove accessory can be quickly placed over the glove to enable touch screen use and can be easily removed again when finished without the primary ordinary glove ever needing to be removed.

To this end, the present arrangement provides for a two finger glove accessory with touch screen active tip portions for covering a wearer's thumb and forefinger, and optionally the user's middle finger as well. The glove accessory is dimensioned and styled to be worn over another ordinary non-touch screen enabled-glove such as those used primarily for warmth. This glove accessory allows a user to wear the accessory over a normal glove but with the benefit of being able to use touch screen products without the wearer having to remove such underlying gloves. Such a feature is possible using the present glove accessory owing to a novel and inventive construction that is able to maintain an electromechanical field connection between the user's skin and the touch screen active tip portions owing to a continuity of the metallic element along an inner seam towards the user's wrists and as described in more detail below.

BRIEF DESCRIPTION OF THE DRAWINGS

The present invention can be best understood through the following description and accompanying drawings, wherein.

DETAILED DESCRIPTION

Figure 1:
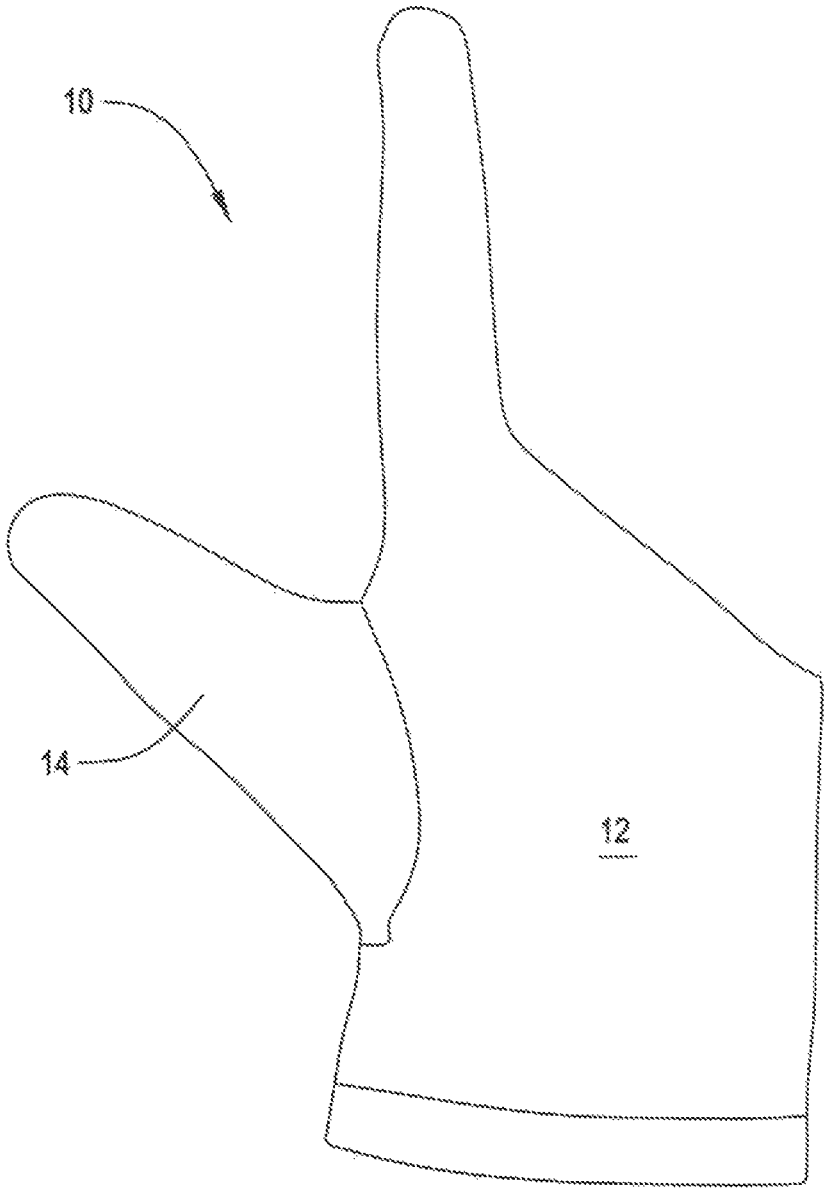
FIG. 1 shows the glove accessory as an independent item in accordance with one embodiment.

In one embodiment as shown in the first exemplary FIG. 1 a glove accessory 10 has a hand portion 12, a thumb portion 14 and an index finger portion 16. As shown in FIG. 1, the area for the remaining three fingers is left open to allow the fingers in the primary glove to pass through as illustrated in later figures.

Figure 2:
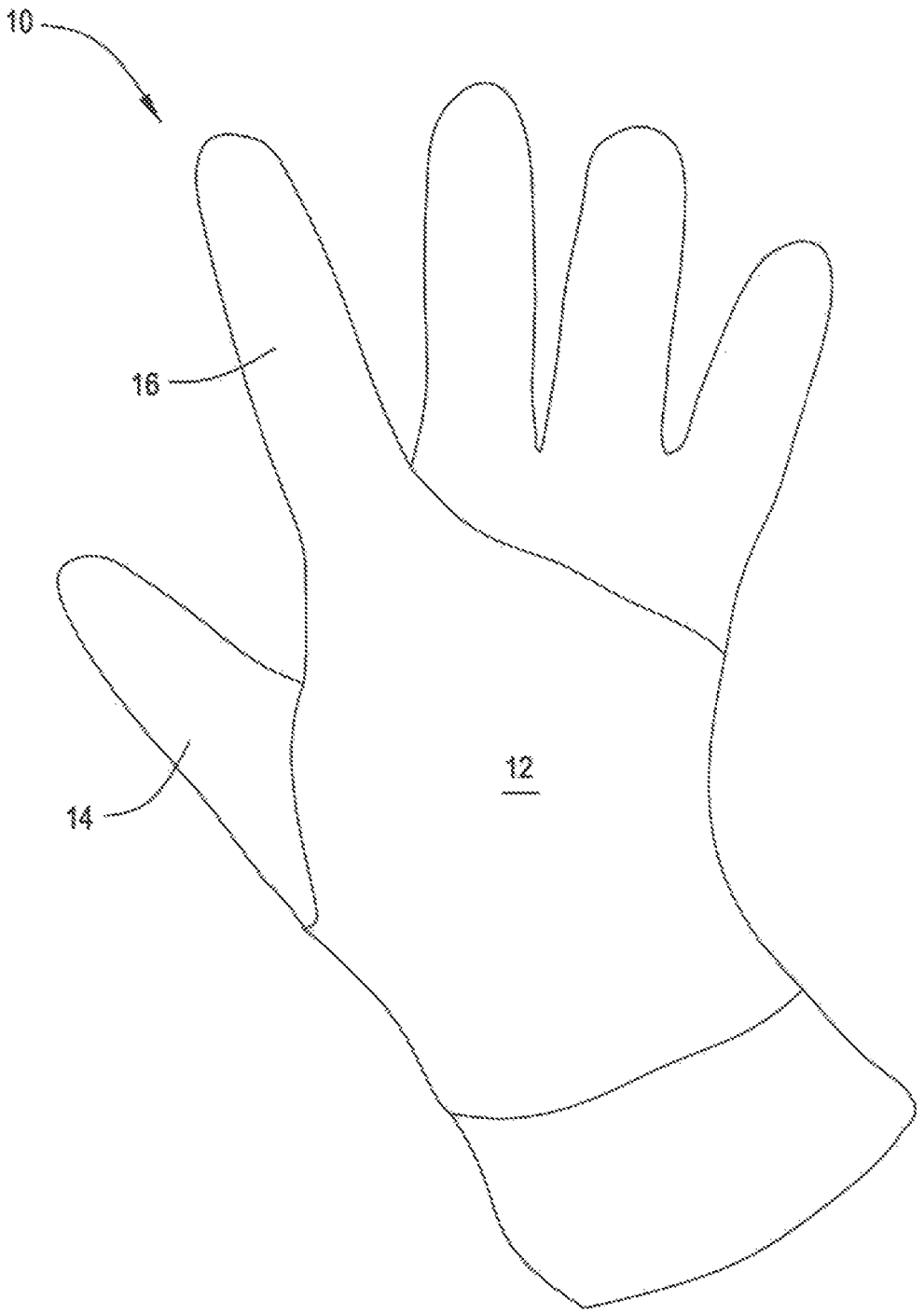
FIG. 2 is a top view of the glove accessory of FIG. 1 disposed over an underlying black fabric glove in accordance with one embodiment.

In one embodiment, the fabric of glove accessory 10 is preferably stretchable so as to easily fit over an underlying glove already on the users hand, however this is not necessarily a requirement. For example, the fabric of glove accessory 10 may include, but is not limited to, suede, faux suede, leather, faux leather, SPANDEX™, AND LYCRA™ and may be available in varied patterns and colors. As an alternative the material used for all or a portion of glove accessory 10 could be an enabled leather or enabled synthetic leather material, for example making the palm side of the glove accessory using conductive leather (i.e. from the tips to the wrist of the palm side of accessory 10). FIG. 2 shows glove accessory 10 as fitted over a black leather ordinary glove.

Figure 3:
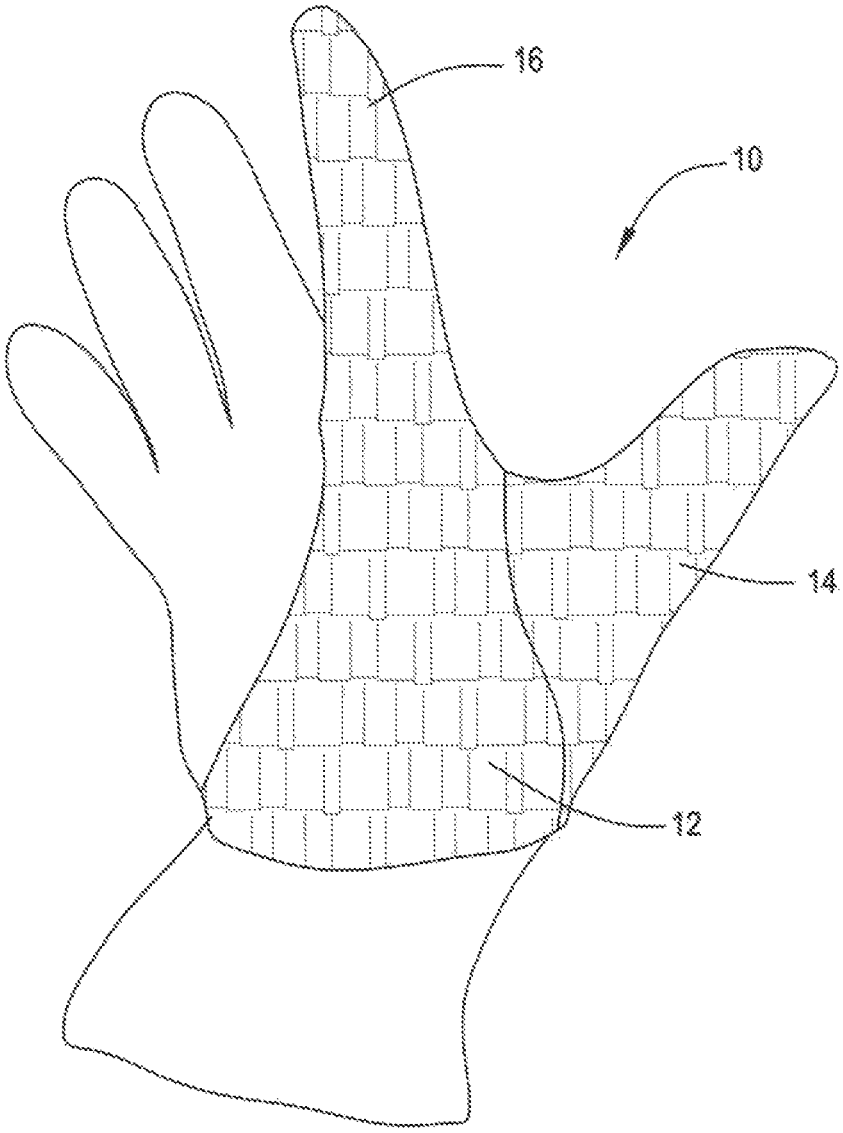
FIGS. 3 and 4 are top and bottom views of a leopard print glove accessory disposed over an underlying black leather glove in accordance with one embodiment.
Figure 4:
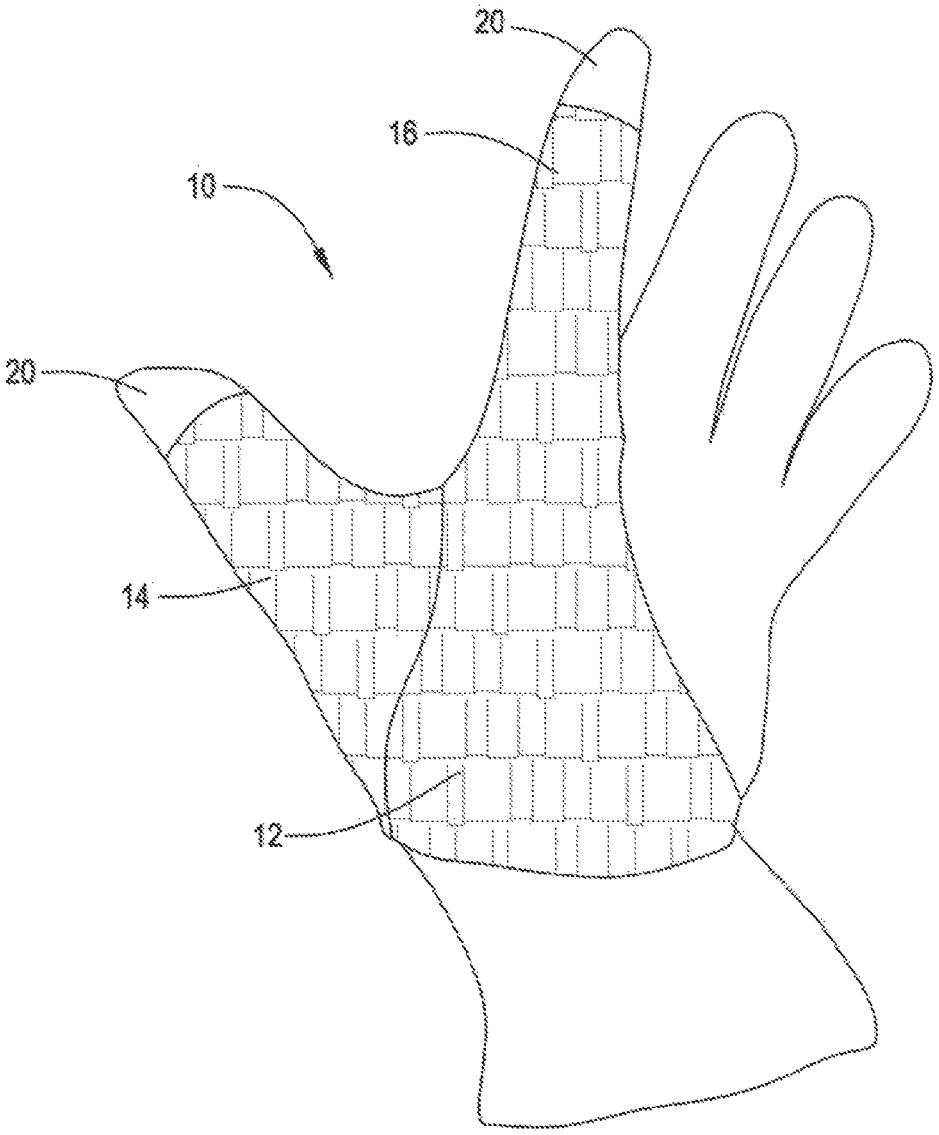
Figure 5:
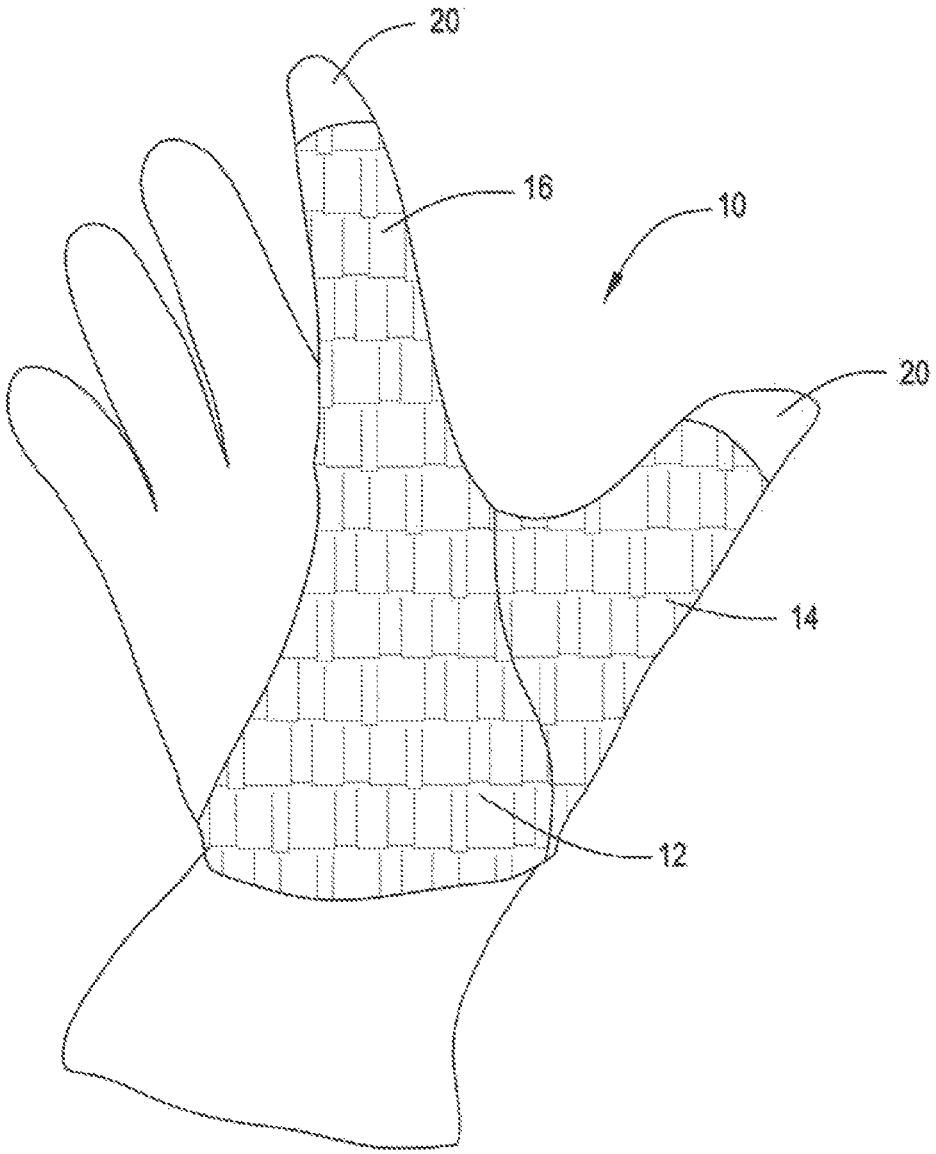
FIG. 5 is a bottom view of the leopard print glove accessory disposed over an underlying black fabric glove in accordance with one embodiment.

FIGS. 3 and 4 show an alternative pattern glove accessory 10 fitted over the black leather ordinary glove, with FIG. 3 showing the back side of accessory 10 and FIG. 4 showing the front side. FIG. 5 shows that same view of accessory 10 as in FIG. 4 with a different underlying ordinary glove of a different fabric.

Figure 6:
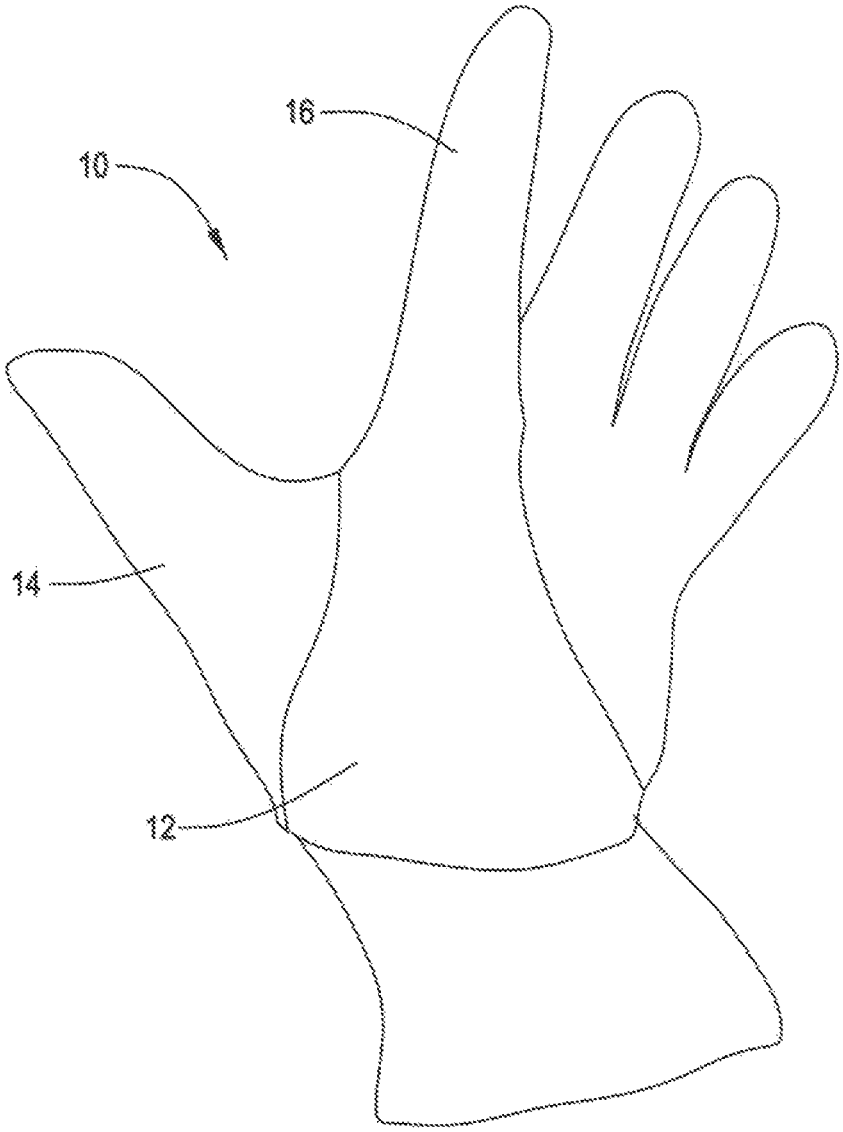
FIGS. 6 and 7 are top and bottom views of a patterned glove accessory disposed over an underlying black leather glove in accordance with one embodiment.
Figure 7:
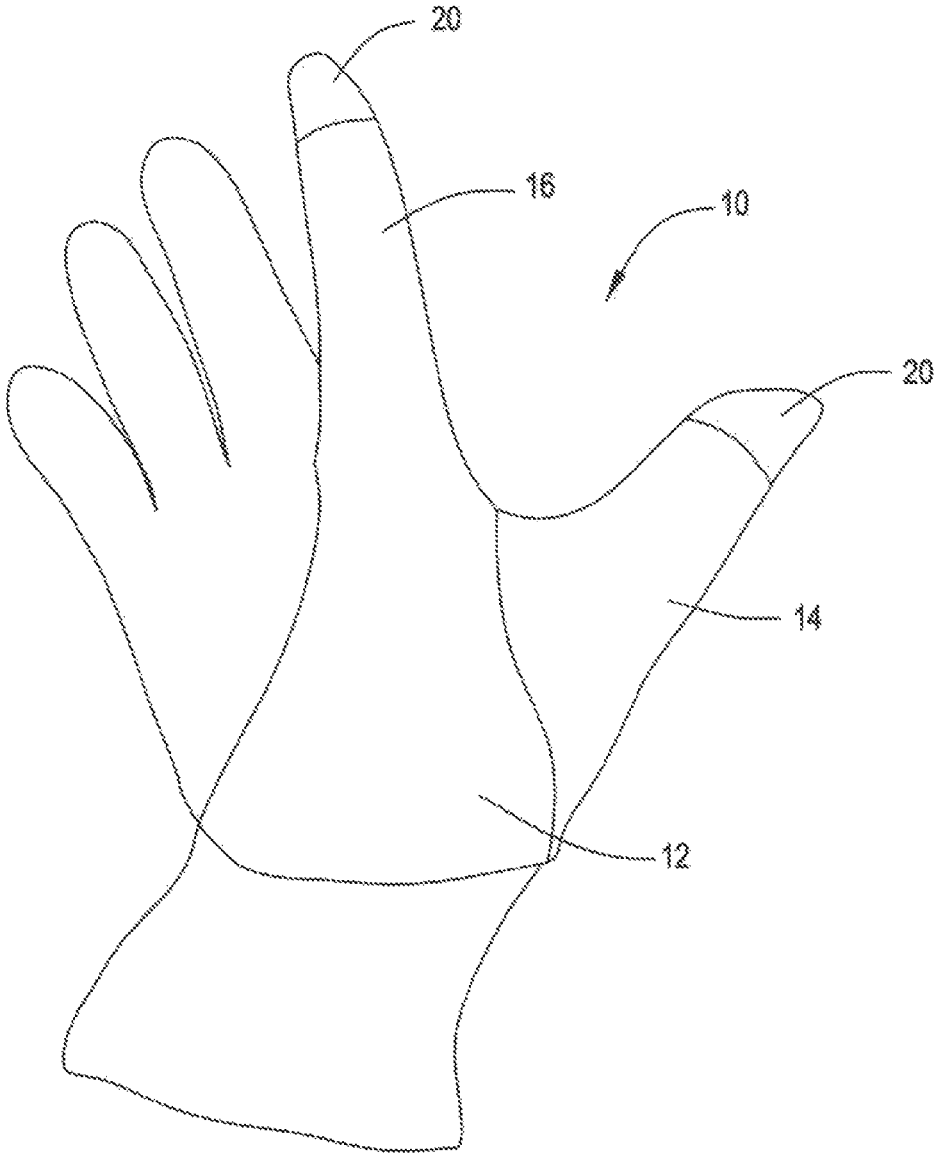

FIGS. 6 and 7 show an alternative glove accessory 10, with a shiny black stretch fabric fitted over the black leather ordinary glove, with FIG. 6 showing the back side of accessory 10 and FIG. 7 showing the front side.

Figure 8:
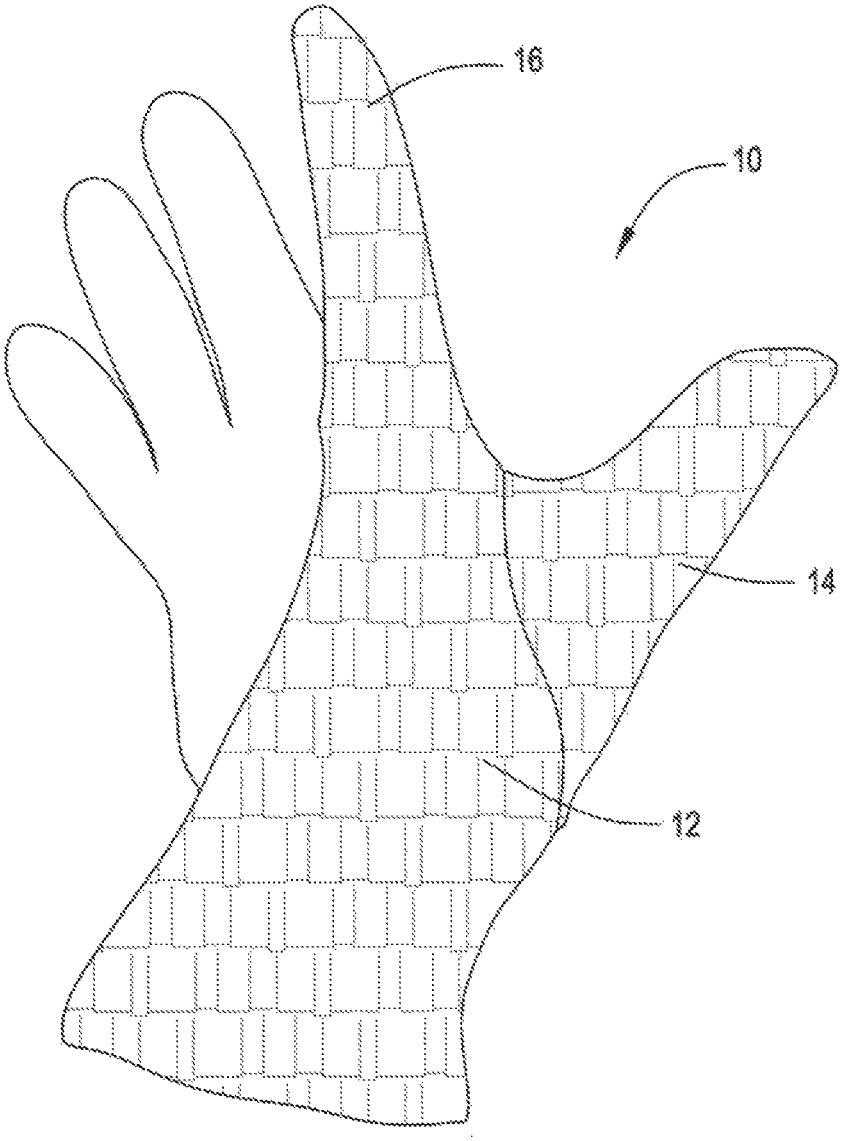
FIG. 8 is a top view of a leopard print glove accessory disposed over an underlying leather glove with an extended cuff region near the wearer's wrist in accordance with one embodiment.

FIG. 8, shows an additional alternative pattern glove accessory 10 with an extended wrist portion for covering over longer gloves, fitted over the black leather ordinary glove, showing the back side of accessory 10.

As shown in FIGS. 4, 5 and 7, glove accessory 10 has touch screen active tip portions 20 located on the inside tips of thumb portion 14 and index finger portion 16. It is noted that optionally touch screen active tip portions 20 may be located solely at the inside tips of index finger portion 16.

Touch screen active tip portions 20 may be in the form of a covering on the material within the tips of thumb portion 14 and index finger portion 16. This covering is made from or contains a conductive material to allow for touch screen and texting capabilities. The conductive material may either be sewn onto the top or inside of the fabric of glove accessory 10, incorporated directly into the fabric of glove accessory 10 or may be a small metal material sewn into or on top of the fabric, covering the tips of thumb portion 14 and index finger portion 16.

As noted above, the design of glove accessory 10, is to be worn over a primary glove. In this case, as the wearer is still wearing the primary glove and thus touch screen active tip portions 20, despite being conductive would not conductively couple with the user's finger tip. This would lead to interference of the signal from the wearer's finger preventing the proper function of the touch screen.

In order to address this issue, the present glove accessory 10 includes a material that in some manner electrically connects touch screen active tip portions 20 at the tips of accessory 10 to some other location lower on accessory 10 (towards the wrist) so that it can contact the user's skin. This connection with the skin, electrically conductively connected to touch screen active tip portions 20 of accessory 10, allow tip portions 20 to continue to work properly in connection with the touch screen device, despite the fact that the wearer is wearing an insulated glove directly beneath those tip portions 20.

Figure 9:
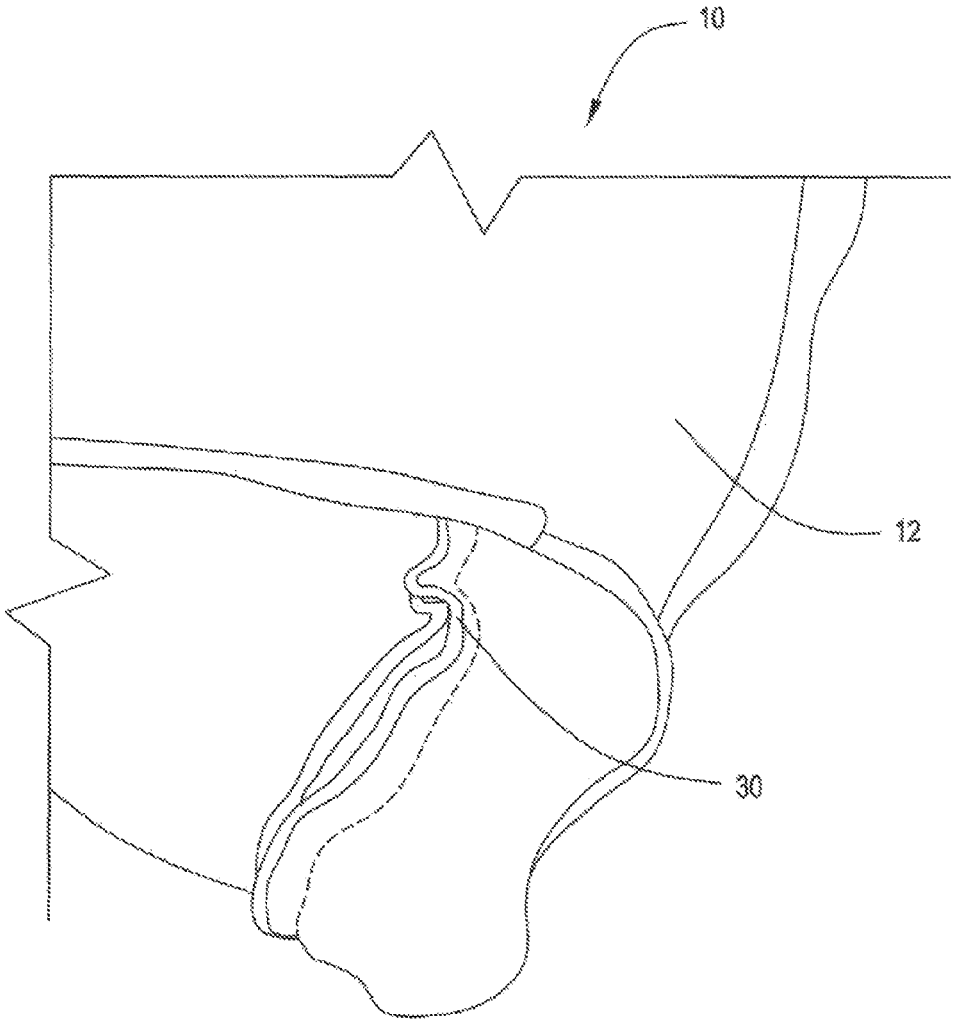
FIG. 9 is a close up view of the rolled up cuff of the glove accessory of FIG. 8 showing the metallic thread seam that extends to the end of the accessory in accordance with one embodiment.
Figure 10:
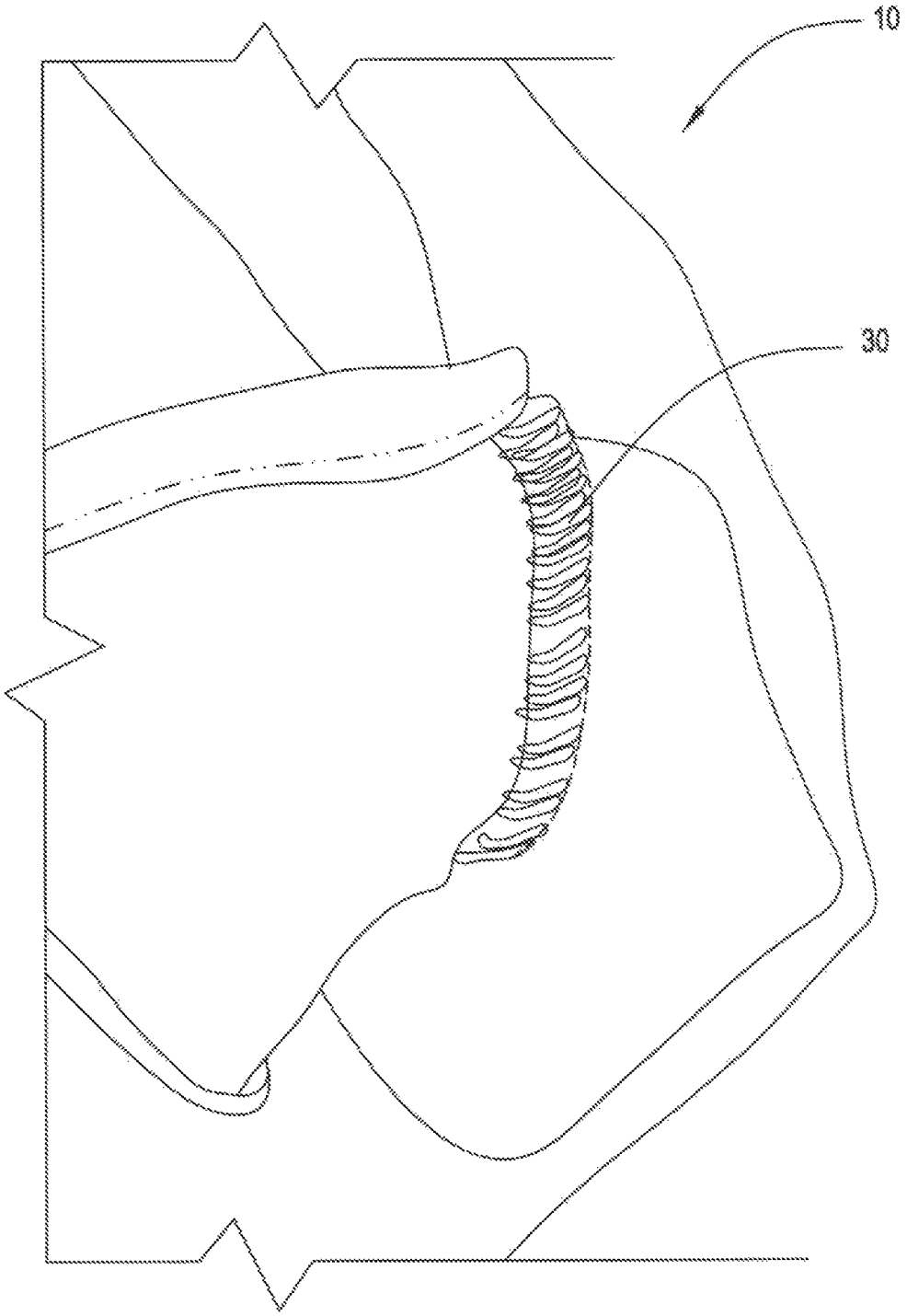
FIG. 10 is a close up view of the rolled up cuff of an alternative glove accessory similar to FIG. 8 showing the metallic thread seam that extends to the end of the accessory.

In one embodiment a metallic thread or material 30 is sewn into the seam of the glove so that it runs down from touch screen active tip portions 20 at the tips of accessory 10 down through glove accessory 10 to the cuff area. For example, in one exemplary embodiment the conductive material, whether being an independent thread that is sewn onto the fabric of accessory 10, or if it is a conductive material that is incorporated into the fabric of accessory 10 itself, thread or material 30 extends down the inseam. In other words, whatever touch screen active tip portions 20 are made from, that same conductive material and/or conductive thread 30 runs from thumb/finger portions 14/16 to the cuff or wrist area where it can come into contact with skin. This is best illustrated in FIGS. 9 and 10 which show a turned up area of the cuff/wrist portion of accessory 10 where material/thread 30 is shown on the inseam of accessory 10.

Such an arrangement ensures that the electromechanical field connection with the user's hand/wrist is able to be maintained, all the way up through touch screen active tip portions 20 providing the necessary capacitive change for touch screen activation at the location where the user's finger tip contacts the screen, even though accessory 10 is fitted over an underlying ordinary warmth glove.

In an alternative arrangement, it is contemplated that if the operation of touch screen active tip portions 20 of accessory 10 is still interfered with, even with material/thread 30, owing to the primary glove underneath, additional power and or charging may be applied to either one of touch screen active tip portions 20, material/thread 30 or both.

Such a glove accessory 10 differs from the prior art because it does not require covering the entire hand like a full glove and is intended to be worn over another glove used for warmth. This allows the wearer to use their touch screen products when wearing accessory 10 without having to remove the glove beneath the device and exposing the hand or in the case of another two finger glove, three other fingers, to inclement weather. The style of the device also differs from prior art by affording the consumer options in fabric (ie, leather, suede, SPANDEX™, LYCRA™) and design i.e. (leopard, tie-dye, varied solid colors). Additionally, if the user is finished with their mobile/touch screen device, they can remove accessory 10 quickly, without having to remove the underlying glove.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. An independent glove accessory configured to be applied over a gloved hand of a user, said glove accessory comprising:

a hand portion;

a thumb portion; and an index finger portion, said glove accessory is constructed of a non-electrically conductive stretchable fabric and configured to be applied over said gloved hand and removable from said gloved hand without the need to remove the glove, the glove being entirely electrically insulating, wherein at least one of said thumb portion or said index finger portion or both on said glove accessory maintains an electrically conductive touch screen active tip, wherein said electrically conductive touch screen active tip is in electrical communication with an end of said hand portion of said glove accessory via conductive thread sewn directly into said non-electrically conductive stretchable fabric, along an inner seam of said glove accessory stitched down through said hand portion, so that said conductive material is incorporated directly therein, where said conductive material extends sufficiently to said end of said hand portion, thus being adapted to allow electrical communication between said touch screen active tip and an exposed skin of said user below said end of said glove.

2. The glove accessory as claimed in claim 1, wherein said glove accessory is made from a material selected from the group consisting of suede, faux suede, leather, faux leather, synthetic stretchable fabrics, enabled leather and enabled synthetic leather.

3. The glove accessory as claimed in claim 1, wherein said electrical communication between said touch screen active tip and said hand portion of said glove accessory is via an electrically conductive fabric used for said glove accessory through said hand portion.

4. The glove accessory as claimed in claim 1, wherein said touch screen active tip is sewn directly into a fabric of said thumb portion, said index finger portion or both of said glove accessory.

5. The glove accessory as claimed in claim 1, wherein said touch screen active tip is sewn onto a fabric of said thumb portion, said index finger portion or both of said glove accessory.

6. The glove accessory as claimed in claim 1, wherein said glove accessory further comprises an extended wrist portion extended from the bottom of the hand portion, configured to extend over an extended wrist portion on said glove on said user's hand.

7. An independent glove accessory configured to be applied over a gloved hand of a user, said glove accessory comprising:

a hand portion;

a thumb portion; and an index finger portion, said glove accessory is constructed of a non-electrically conductive stretchable fabric and configured to be applied over said gloved hand and removable from said gloved hand without the need to remove the glove, the glove being entirely electrically insulating, wherein at least one of said thumb portion or said index finger portion or both of said glove accessory maintains an electrically conductive touch screen active tip, wherein said electrically conductive touch screen active tip is in electrical communication with an end of said hand portion of said glove accessory via conductive material that is a conductive thread extending down the inseam of said non-electrically conductive stretchable fabric so that said conductive material is interwoven therewith, where said conductive material extends sufficiently to said end of said hand portion, thus being adapted to allow electrical communication between said touch screen active tip and an exposed skin of said user below said end of said glove.

* * * * *